US008502162B2

(12) United States Patent
Loucks, Jr. et al.

(10) Patent No.: US 8,502,162 B2
(45) Date of Patent: Aug. 6, 2013

(54) ATMOSPHERIC PRESSURE IONIZATION APPARATUS AND METHOD

(75) Inventors: Harvey D. Loucks, Jr., La Honda, CA (US); Paul C. Goodley, Healdsburg, CA (US)

(73) Assignee: Agilent Technologies, Inc., Santa Clarita, CA (US)

( * ) Notice: Subject to any disclaimer, the term of this patent is extended or adjusted under 35 U.S.C. 154(b) by 79 days.

(21) Appl. No.: 13/164,386

(22) Filed: Jun. 20, 2011

(65) Prior Publication Data

US 2012/0318973 A1 Dec. 20, 2012

(51) Int. Cl.
*H01J 27/02* (2006.01)
*H01J 49/10* (2006.01)

(52) U.S. Cl.
USPC ..... 250/424; 250/423 F; 250/288; 250/283

(58) Field of Classification Search
USPC ..... 250/281, 282, 288, 283, 423 R, 424, 250/423 F
See application file for complete search history.

(56) References Cited

U.S. PATENT DOCUMENTS

| | | | | |
|---|---|---|---|---|
| 5,658,413 | A | 8/1997 | Kaltenbach et al. | |
| 5,838,003 | A * | 11/1998 | Bertsch et al. | 250/288 |
| 5,844,237 | A * | 12/1998 | Whitehouse et al. | 250/288 |
| 6,992,299 | B2 * | 1/2006 | Lee et al. | 250/396 R |
| 7,145,136 | B2 * | 12/2006 | Yang et al. | 250/288 |
| 7,204,431 | B2 * | 4/2007 | Li et al. | 239/3 |
| 7,385,189 | B2 * | 6/2008 | Goodley et al. | 250/288 |
| 7,397,028 | B2 * | 7/2008 | Brennen et al. | 250/288 |
| 7,495,210 | B2 | 2/2009 | Li | |
| 7,564,029 | B2 | 7/2009 | Wang et al. | |
| 7,816,645 | B2 | 10/2010 | Kelly et al. | |
| 7,855,357 | B2 * | 12/2010 | Truche et al. | 250/288 |
| 2003/0071209 | A1 * | 4/2003 | Park et al. | 250/288 |
| 2005/0092855 | A1 * | 5/2005 | Li et al. | 239/690.1 |
| 2005/0269506 | A1 * | 12/2005 | Kalinitchenko | 250/288 |
| 2006/0054805 | A1 * | 3/2006 | Flanagan et al. | 250/288 |
| 2007/0023676 | A1 * | 2/2007 | Goodley et al. | 250/425 |
| 2007/0164231 | A1 * | 7/2007 | Truche et al. | 250/423 R |
| 2007/0221839 | A1 | 9/2007 | Goodley et al. | |
| 2008/0067356 | A1 * | 3/2008 | Goodley et al. | 250/288 |
| 2008/0142697 | A1 * | 6/2008 | Dahl et al. | 250/282 |
| 2009/0294660 | A1 * | 12/2009 | Whitehouse et al. | 250/288 |
| 2010/0230268 | A1 * | 9/2010 | Garner | 200/81 R |
| 2010/0243885 | A1 * | 9/2010 | Tepper et al. | 250/284 |
| 2010/0320374 | A1 * | 12/2010 | Jarrell et al. | 250/282 |
| 2012/0280141 | A1 * | 11/2012 | Kovtoun et al. | 250/424 |

* cited by examiner

*Primary Examiner* — David A Vanore
*Assistant Examiner* — Wyatt Stoffa

(57) ABSTRACT

An atmospheric pressure ionization apparatus includes a chamber, an ion inlet structure, an electrode, a sample emitter, and a gas passage. The ion inlet structure includes a sampling orifice. The electrode includes an electrode bore. An ionization region is defined between the ion inlet structure and the electrode. The flared structure is coaxially disposed about the ion inlet structure, and extends along an outward direction that includes a radial component relative to the sampling axis. The sample emitter is oriented at an angle to the sampling axis for directing a sample stream toward the ionization region. The gas passage directs a stream of gas from a gas source to the chamber. The flared structure and the wall cooperatively form an outward-directed portion of the gas passage that extends annularly about the sampling axis and along the outward direction. The gas flows through the outward-directed portion, around the flared structure, and toward the ionization region and the electrode bore.

20 Claims, 5 Drawing Sheets

ATMOSPHERIC PRESSURE IONIZATION APPARATUS AND METHOD

TECHNICAL FIELD

The present invention relates generally to atmospheric pressure ionization, such as may be implemented in an ion source providing an interface with an analytical instrument such as a mass spectrometer.

BACKGROUND

Certain techniques of analytical chemistry such as mass spectrometry (MS) require that components of a sample be ionized prior to analysis. Generally, MS encompasses a variety of instrumental methods of qualitative and quantitative analysis that enable ionized species of analytes (i.e., sample molecules of interest) to be resolved according to their mass-to-charge ratios. For this purpose, an MS system converts certain components of a sample into ions, sorts, separates or filters the ions based on their mass-to-charge ratios, and processes the resulting ion output (e.g., ion current or flux) as needed to produce a mass spectrum. Typically, a mass spectrum is a series of peaks indicative of the relative abundances of charged components as a function of mass-to-charge ratio.

A typical MS system includes a sample source, an ion source or ionization device, one or more mass analyzers, an ion detector, a signal processor, a readout/display means, and an electronic controller such as a computer. The MS system also includes a vacuum system to enclose the mass analyzer (s) in a controlled, evacuated environment. In atmospheric-pressure ionization (API) techniques, the sample material provided to the ion source is ionized at or near atmospheric pressure in an ionization chamber that is separated from the evacuated regions of the mass analyzer. Ions produced in the atmospheric-pressure ionization chamber are transported into the evacuated environment of the mass spectrometer via a sampling orifice. API techniques are particularly useful when it is desired to couple mass spectrometry with an analytical separation technique such as liquid chromatography (LC). For instance, the eluant from an LC column may serve as the sample source leading into the ionization chamber. Typically, the effluent consists of a liquid-phase matrix of analytes and mobile-phase material (e.g., solvents, additives, buffers).

Examples of API techniques include electrospray ionization (ESI), atmospheric-pressure chemical ionization (APCI), atmospheric-pressure photo-ionization (APPI), atmospheric-pressure laser ionization (APLI), and atmospheric-pressure matrix-assisted laser desorption/ionization (AP-MALDI). API techniques such as these are known and therefore need not be described in detail.

In the case of ESI, a liquid sample is introduced into the ionization chamber through an electrospray needle. A voltage potential is applied between the needle and a secondary electrode (or counter-electrode) in the ionization chamber to establish an electric field within the ionization chamber. The electric field induces charge accumulation at the surface of the liquid at or near the tip of the needle, and the liquid sample is discharged from the needle in the form of highly charged droplets (electrospray). The breaking of the stream of liquid into a mass of fine droplets, or aerosol, may be assisted by a nebulizing technique that may involve pneumatic, ultrasonic, thermal or electrostatic means. For example, pneumatic nebulization may be implemented by providing a tube coaxial to the electrospray needle and discharging an inert gas such as nitrogen coaxially with the sample liquid. An electric field directs the charged droplets from the tip of the electrospray needle toward the sampling orifice that leads from the ionization chamber to the mass spectrometer. The droplets undergo a process of desolvation or ion evaporation as they travel through the ionization chamber. As solvent contained in the droplets evaporates, the droplets become smaller. In addition, the droplets may rupture and divide into even smaller droplets as a result of repelling coulombic forces approaching the cohesion forces of the droplets. Eventually, charged analyte molecules (analyte ions) desorb from the surfaces of the droplets. More recently, low-flow electrospray and nano-electrospray techniques have been developed. Low-flow electrospray and nano-electrospray techniques entail flowing the liquid sample through a small-bore needle (or sample emitter) at a micro-scale or nano-scale flow rate. These techniques can be advantageous in that a lesser amount of sample is required, assisted nebulization is not required to form fine droplets, ions are liberated from the sample primarily through the mechanism of ion evaporation, and a higher ion signal-to-noise ratio (S/N) may be achieved.

In any API technique, ideally only the analyte ions enter the mass spectrometer, and not the other components of the sample spray such as neutral solvated droplets, or air or oxygen. To this end, a stream of an inert (and typically heated) drying gas such as nitrogen is introduced into the ionization chamber to assist in the evaporation of solvent and/or sweep the solvent away from the sampling orifice leading into the mass spectrometer, as well as to assist in the evaporation and desolvation of ions from the sample spray. Conventionally, the drying gas is introduced through one or two openings in counterflow relation to the spray as the spray approaches the sampling orifice. Alternatively, the drying gas is introduced as a curtain in front of the sampling orifice. In conventional API apparatus, the velocity and path of the drying gas entering the ionization chamber is not optimized for collecting analyte ions and producing a good ion signal from the sample material. The high-velocity drying gas creates unwanted gas turbulence in the ionization chamber that disrupts the sample spray, particularly in implementations where the sample spray is a low-flow electrospray or nano-electrospray. Additionally, the geometry of the ionization chamber and the components contained therein such as the secondary electrode—as well as the velocity, degree of turbulence, and path of the drying gas—have been found to create a low-pressure gas stagnation zone in front of the secondary electrode. Little or no gas flows in this stagnation zone. Also, the stagnation zone fluctuates into and out from the sample spray, thereby significantly perturbing the sample spray and contributing to its instability. Moreover, the drying gas is directed in a manner that fails to heat the ionization chamber uniformly, and may leave the majority of the ionization chamber unheated. As a result, in some designs it may be difficult to achieve a stable, smooth liquid sample spray from the sample emitter, and to achieve a uniformly heated environment conducive to aiding in the production of ions, and high-mass ions in particular. In addition, the unstable sample spray allows some of the droplets to enter the capillary and consequently the mass analyzer of the mass spectrometer. The admission of droplets into the mass spectrometer is highly undesirable, as these droplets cause contamination to the inlet parts of the mass spectrometer which in turn requires more frequent cleaning of these parts and the attendant downtime involved. Moreover, these droplets impair the ion signal from which analytical data is derived and lower the sensitivity of the mass spectrometer.

In view of the foregoing, there is an ongoing need for API apparatus that address the problems mentioned above.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an atmospheric pressure ionization (API) apparatus includes a housing, an ion inlet structure, an electrode, a sample emitter, and a gas passage. The housing includes a chamber. The ion inlet structure includes a sampling orifice coaxial with a sampling axis and communicating with the chamber. The electrode includes an electrode bore and is spaced from the ion inlet structure. An ionization region is defined between the ion inlet structure and the electrode. The flared structure is coaxially disposed about the ion inlet structure, and extends along an outward direction that includes a radial component relative to the sampling axis.

The sample emitter is disposed in the chamber, and is oriented at an angle to the sampling axis for directing a sample stream toward the ionization region. The gas passage is configured for directing a stream of gas from a gas source to the chamber. The flared structure forms a portion of the gas passage that extends annularly about the sampling axis and along the outward direction. The gas flows through the portion, around the flared structure, and toward the ionization region and the electrode bore.

According to another implementation, the API apparatus includes an inside wall. The inside wall and one or more inside surfaces of the housing enclose the chamber. The flared structure and the inside wall cooperatively form the portion of the gas passage that extends annularly about the sampling axis.

According to another implementation, the API apparatus includes a gas distributor. The gas distributor includes a plenum coaxial with the sampling axis and communicating with the gas source, and a plurality of outlets circumferentially spaced from each other about the sampling axis and communicating with the portion.

According to another implementation, the electrode includes a cylindrical portion through which the electrode bore extends. The cylindrical portion includes an end surface facing the ionization region, a lateral surface coaxial with the electrode bore, and an annular transition between the end surface and the lateral surface. The annular transition is rounded wherein the cylindrical portion is free of sharp edges.

According to another implementation, an inside wall of the API apparatus is disposed between the chamber and an evacuated region of a mass spectrometer.

According to another implementation, the ion inlet structure includes a sampling bore communicating with the sampling orifice, and an inside diameter of the sampling bore is greater than an inside diameter of the sampling orifice.

According to another implementation, the API apparatus includes an ion transport device extending through an inside wall of the housing, and the ion transport device includes one or more channels communicating with the sampling bore.

According to another implementation, the API apparatus includes a voltage source in signal communication with the ion inlet structure and configured for generating an electric field having a spatial distribution and polarity that attracts ions of a selected polarity toward the sampling orifice.

According to another implementation, the API apparatus includes a first voltage source in signal communication with the ion inlet structure and configured for applying a voltage ranging from 100 V to 6000 V, and a second voltage source in signal communication with the electrode and configured for applying a voltage ranging from 100 V to 1000 V less than the voltage applied to the ion inlet structure.

According to another implementation, the electrode bore is coaxial with the sampling axis.

According to another implementation, the flared structure includes a first outer surface facing the chamber, the ion inlet structure comprises a second outer surface facing the chamber, and the first outer surface abuts the second outer surface in a smooth transition.

According to another implementation, the flared structure includes an outer surface facing the chamber, and the outer surface has a curvature. In some implementations, the curvature has at least two inflection points of opposite signs.

According to another implementation, the outward direction along which the flared structure extends additionally includes an axial component, and at least a portion of the flared structure extends toward an inside wall of the housing at a non-ninety degree angle to the sampling axis.

According to another implementation, the sample emitter is oriented substantially orthogonally to the sampling axis.

According to another implementation, the sample emitter has an internal diameter ranging from 700 nm to 35,000 nm.

In some implementations, the sample emitter is configured for emitting the sample stream into the chamber at a flow rate ranging from 0.0001 μL/min to 20 μL/min. In other implementations, the sample emitter is configured for emitting the sample stream into the chamber at a flow rate ranging from 0.0001 μL/min to 5 μL/min. In other implementations, the sample emitter is configured for emitting the sample stream into the chamber at a flow rate ranging from 0.0001 μL/min to 1 μL/min.

According to another implementation, the portion of the gas passage terminates at an annular gas outlet communicating with the chamber, and the annular gas outlet is defined between a rim of the flared structure and an inside wall of the housing.

According to another implementation, the API apparatus includes a gas inlet extending through an inside wall of the housing and communicating with the gas passage. In some implementations, the ion inlet structure includes an annular recess, the gas inlet includes a cylindrical structure extending into the annular recess, and the annular recess and the cylindrical structure cooperatively define a gas path running axially from the gas inlet toward the ion inlet structure, followed by running toward the gas passage at an angle to the sampling axis. In some implementations, the gas passage includes a gas distributor. The gas distributor may include a plenum communicating with the annular recess, and a plurality of outlets or radial holes circumferentially spaced from each other about the sampling axis and communicating with the portion.

In some implementations, the gas passage is configured for moving the stream of gas into the chamber at a velocity ranging from 0.01 m/s to 1.0 m/s. In other implementations, the gas passage is configured for moving the stream of gas into the chamber at a velocity ranging from 0.01 m/s to 0.5 m/s.

According to another implementation, a mass spectrometry (MS) system includes an API apparatus according to any of the implementations disclosed herein. The MS system may further include an ion transport device communicating with the sampling orifice and extending through an inside wall of the housing, and a mass spectrometer communicating with the ion transport device and separated from the chamber by the inside wall.

In some implementations, the MS system includes a sample source configured for flowing the sample stream through the sample emitter at a flow rate ranging from 0.0001 μL/min to 20 μL/min. In other implementations, the MS system includes a sample source configured for flowing the sample stream through the sample emitter at a flow rate ranging from 0.0001 μL/min to 5 μL/min. In other implementations, the MS system includes a sample source configured for flowing the sample stream through the sample emitter at a flow rate ranging from 0.0001 μL/min to 1 μL/min.

According to another implementation, a method is provided for ionizing a sample. A sample stream is discharged from a sample emitter into an ionization region located between an ion inlet structure and a secondary electrode in a chamber. The sample stream is subjected to an electrostatic field by applying respective voltages to the sample emitter, the ion inlet structure, and the secondary electrode, wherein ions are produced and enter the ion inlet structure along a sampling axis. A drying gas is flowed through a gas passage in a plurality of radial directions relative to the sampling axis, and toward the ionization region. A portion of the drying gas is flowed through a bore of the secondary electrode.

According to another implementation, the drying gas is flowed through an annular portion of the gas passage between a flared structure and an inside wall of the chamber, wherein the flared structure extends coaxially about the ion inlet structure. In some implementations, the drying gas may be flowed through a plenum, through a plurality of radial holes and into the annular portion, wherein the plenum and the radial holes are coaxial with the sampling axis. In some implementations, the drying gas may flow into contact with a back side of the ion inlet structure opposite to the ionization region, change direction, and then flow into the plenum.

According to another implementation, the drying gas is flowed through a plenum, through a plurality of radial holes and into the gas passage.

In some implementations, the sample stream is discharged from the sample emitter at a flow rate ranging from 0.0001 μL/min to 20 μL/min. In other implementations, the sample stream is discharged from the sample emitter at a flow rate ranging from 0.0001 μL/min to 5 μL/min. In other implementations, the sample stream is discharged from the sample emitter at a flow rate ranging from 0.0001 μL/min to 1 L/min.

In some implementations, the drying gas is flowed from the gas passage into the chamber at a velocity ranging from 0.01 m/s to 1.0 m/s. In other implementations, the drying gas is flowed from the gas passage into the chamber at a velocity ranging from 0.01 m/s to 0.5 m/s.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

In the context of the present disclosure, the term "atmospheric pressure" is not limited to an exact value for atmospheric pressure such as 1 atmosphere (760 Torr) at sea level. Instead, the term "atmospheric pressure" also generally encompasses any pressure that is substantially at (i.e., about, approximately, or near) atmospheric pressure. Accordingly, "atmospheric pressure" generally encompasses a range of pressures from about 720 Torr to about 800 Torr.

Figure 1:
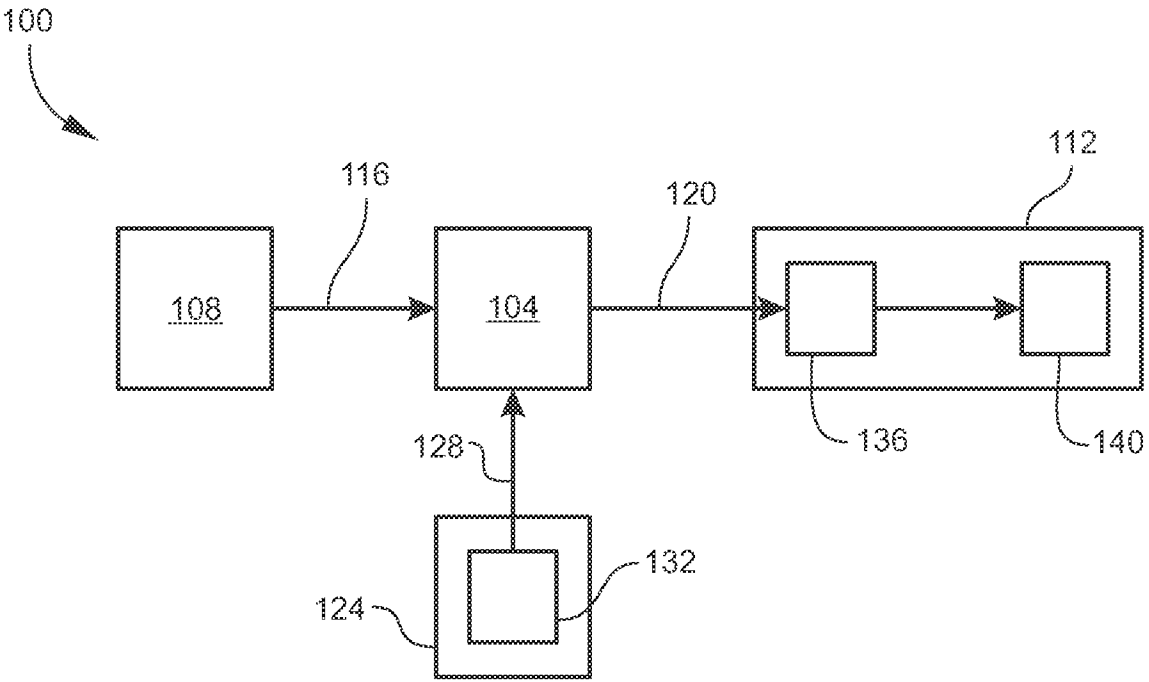
FIG. 1 is a schematic view of an example of a mass spectrometry (MS) system in which an atmospheric pressure ionization (API) apparatus as disclosed herein may operate.

FIG. 1 is a schematic view of an example of an analytical system, such as a mass spectrometry (MS) system 100, in which an atmospheric pressure ionization (API) apparatus 104 as disclosed herein may operate. The MS system 100 may generally include a sample source 108, the API apparatus 104, and a mass spectrometer 112. The sample source 108 may be any device configured for providing a stream 116 of sample material (or sample stream) to the API apparatus 104. As examples, the sample source 108 may be associated with a batch volume, a sample probe, or a liquid handling system. In hyphenated techniques, the sample source 108 may be associated with the output of an analytical separation instrument such as a gas chromatographic (GC) instrument, a liquid chromatographic (LC) instrument, a capillary electrophoresis (CE) instrument, a capillary electrochromatography (CEC) instrument, or the like. The sample source 108 may also be associated with a microfluidic or nanofluidic chip such as disclosed, for example, in U.S. Patent App. Pub. No. 2007/0221839 or U.S. Pat. No. 5,658,413, the entire contents of which are incorporated by reference herein. The flow of the sample material to the API apparatus 104 may be effected by any means, such as pumping, capillary action, or an electrically-assisted technique.

The API apparatus 104 is an ion source, configured for producing analyte ions 120 from the sample stream 116 received from the sample source 108 and directing the as-produced ions 120 into the mass spectrometer 112. Non-limiting examples of the API apparatus 104 are described further below, particularly in the context of, but not limited to, low-flow electrospray ionization and nano-electrospray (or "nanospray") ionization. The MS system 100 additionally includes a drying gas source 124 for providing a stream 128 of drying gas to the API apparatus 104. The drying gas source 124 may include a heating device 132 for heating the drying gas to a desired temperature, which in some implementations may be varied according to a predetermined temperature profile. The drying gas may be any chemically inert gas suitable for use in API, a few non-limiting examples being nitrogen ($N_2$), carbon dioxide ($CO_2$) and argon (Ar). Depending on the particular implementation, the drying gas source 124 may be considered as being a part of the API apparatus 104.

The mass spectrometer 112 generally includes a mass analyzer 136 and an ion detector 140. The mass analyzer 136 may be any device configured for separating, sorting or filtering analyte ions on the basis of their respective masses. Examples of mass analyzers include, but are not limited to, multi-pole electrode structures, ion traps, time-of-flight (TOF) components, electrostatic analyzers (ESAs), and magnetic sectors. The ion detector 140 may be any device configured for collecting and measuring the flux (or current) of mass-discriminated ions 144 outputted from the mass analyzer 136. Examples of ion detectors include, but are not limited to, electron multipliers, photomultipliers, and Faraday cups.

For purposes of the present disclosure, generally no limitation is placed on the composition of the sample material, the manner in which the sample material is provided to the API apparatus 104, or any particular parameters such as flow rate, pressure, viscosity, unless specified otherwise. In a typical implementation, the sample material provided to the API apparatus 104 is predominantly a fluid, which is predominantly in the liquid phase. For example, the sample material may be a matrix in which analyte components (i.e., molecules of interest) are initially dissolved in one or more solvents or carried by other types of mobile-phase components. In addition to solvents, other non-analytical components (that is, components for which analysis is not desired and/or input into the mass spectrometer 112 is typically not desired) may be present, such as excipients, buffers, additives, dopants, or the like. Depending on the location of a given portion of sample material in the API apparatus 104 or the procedural stage at which ionization is occurring, the sample material may comprise primarily ions alone or ions in combination with other components such as charged and/or neutral droplets, vapor, gas, or the like. Accordingly, the term "sample material" or "sample" as used herein may be generally characterized as a fluent material that includes analytes capable of being ionized in an API apparatus, and otherwise is not limited by any particular phase, form, or composition.

Figure 2:
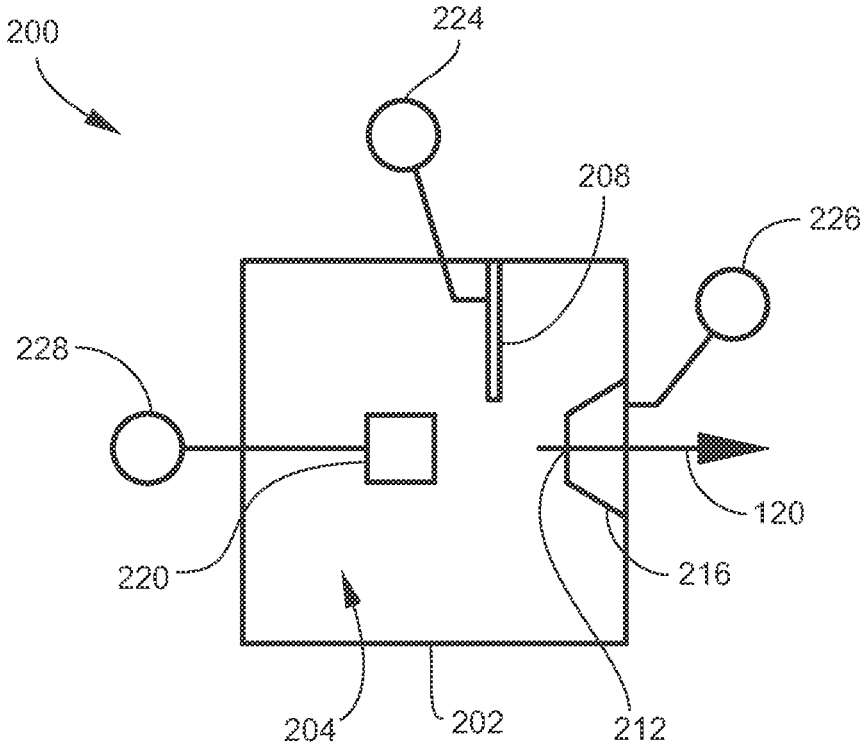
FIG. 2 is a schematic view of an example of an API apparatus that may be utilized in an analytical system such as the MS system illustrated in FIG. 1.

FIG. 2 is a schematic view of an example of an API apparatus 200 that may be utilized in an analytical system such as the MS system 100 illustrated in FIG. 1. The API apparatus 200 generally includes a housing 202 enclosing an ionization chamber (or chamber) 204. The API apparatus 200 also includes an ionization device that includes a sample emitter 208 disposed in (positioned in or extending into) the ionization chamber 204 for emitting a sample stream. In the implementations taught herein, the sample stream may also be characterized interchangeably as a column, jet, or spray, with no limitation being placed on the degree of divergence (if any) of the sample stream, or on the amount, size or distribution of liquid droplets and gas vapors in the sample stream. The API apparatus 200 also includes electrodes positioned in the ionization chamber 204 for generating electrostatic fields that function to extract ions from the sample stream, bias extracted ions toward an ion inlet 212 leading to a mass spectrometer 112 (FIG. 1), or both. In the illustrated example, the electrodes include a primary electrode 216 and a secondary electrode 220. Additional electrodes may be provided, including electrically conductive inside surfaces and other structural components located within the ionization chamber 204. In the illustrated example, the primary electrode 216 also includes the ion inlet 212 that leads to the mass spectrometer 112.

In operation, a voltage is applied to the sample emitter 208 to charge the sample material flowing through the sample emitter 208. Respective voltages are also applied to the primary electrode 216 and the secondary electrode 220 to generate electrostatic fields of desired spatial distributions and polarities. The application of voltages is schematically depicted in FIG. 2 by voltage sources 224, 226, 228 in signal communication with the sample emitter 208, the primary electrode 216 and the secondary electrode 220, respectively. The voltage sources 224, 226, 228 are typically direct-current (DC) voltage sources (or rectified equivalents of DC voltage sources). Generally no limitation is placed on the type of voltage sources 224, 226, 228 utilized, or on whether the individual voltage sources 224, 226, 228 are distinct components or part of a single module configured for applying selected voltages to different electrodes. The devices utilized for applying voltages to electrically conductive components of ion sources are readily ascertainable to persons skilled in the art.

Figure 3:
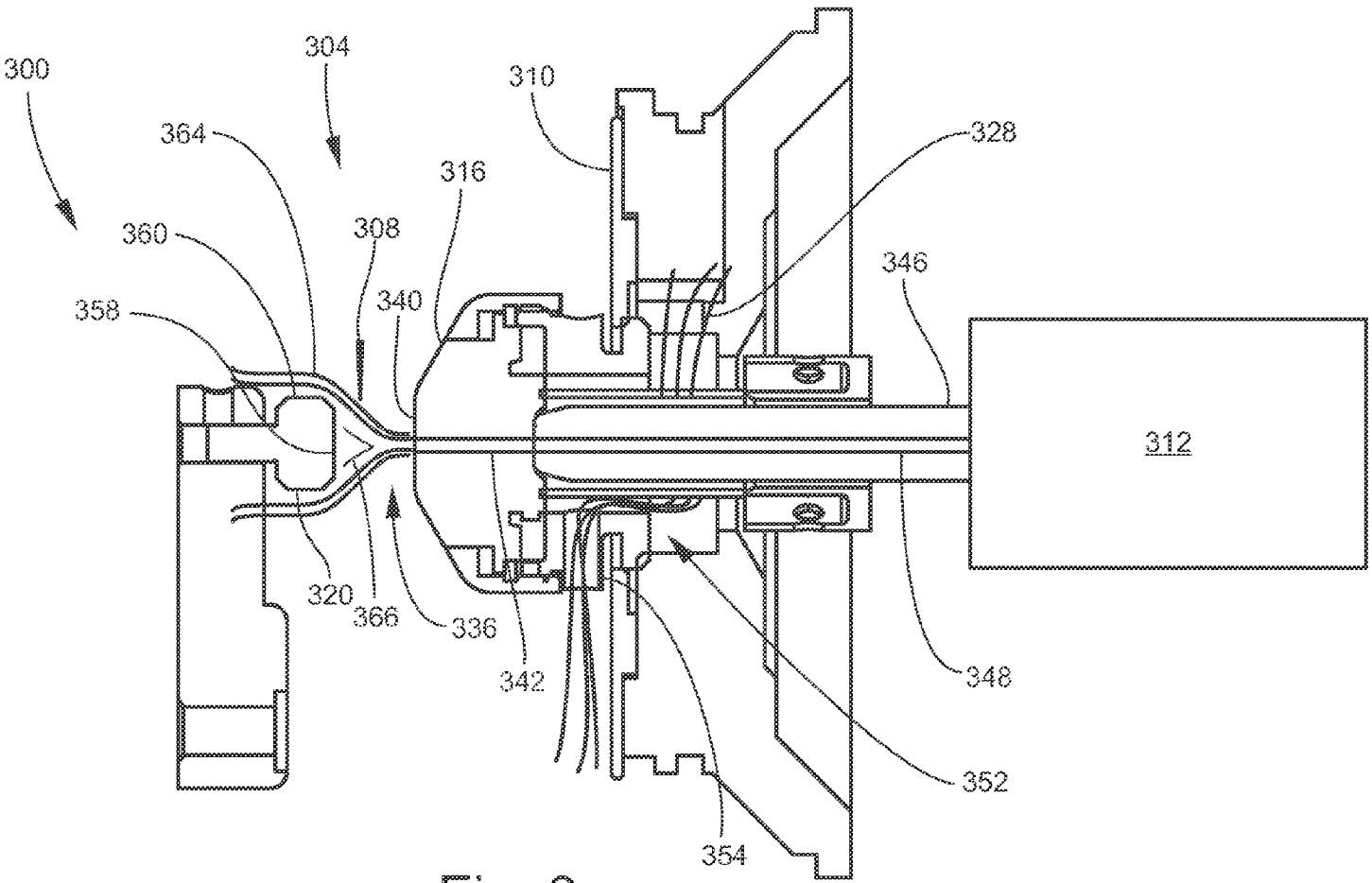
Fig. 3 PRIOR ART
FIG. 3 is a cross-sectional view of a known API apparatus, illustrating lines that depict gas flow.

An API apparatus 300 of known design will now be described with reference to FIG. 3 to facilitate appreciation of the subject matter taught herein. FIG. 3 is a cross-sectional view of the known API apparatus 300. The API apparatus 300 includes a housing (not shown) that encloses an ionization chamber 304. The API apparatus 300 is adjacent to a mass spectrometer 312. One or more inside walls 310 in the housing fluidly isolate the evacuated regions of the mass spectrometer 312 from the ionization chamber 304. A sample emitter 308 is positioned in the ionization chamber 304 and communicates with a sample source (not shown). Sample material supplied by the sample source flows through the sample emitter 308. The sample emitter 308 is energized by a voltage source (not shown), thus charging components of the sample material as it flows through the sample emitter 308. The sample material is discharged from the tip of the sample emitter 308 in the form of a sample spray containing a mixture of charged and neutral components. In the configuration specifically illustrated, the sample material may be discharged from the sample emitter 308 at a low flow rate. Thus, the sample spray may be characterized as a low-flow electrospray for flow rates of 20 μL or less, or a nano-electrospray (or "nanospray") for flow rates of 5 μL or less.

The API apparatus 300 further includes an ion inlet structure 316 and a secondary electrode 320 positioned in the ionization chamber 304. The ion inlet structure 316 serves as a primary electrode for generating an electrostatic field in the ionization chamber 304, and for this purpose is in signal communication with a voltage source (not shown). The secondary electrode 320 is also in signal communication with a voltage source (not shown). In operation voltage potentials are established between the sample emitter 308 and the ion inlet structure 316, and between the sample emitter 308 and the secondary electrode 320. In a typical case, the voltages applied to the sample emitter 308, ion inlet structure 316 and secondary electrode 320 are of a negative polarity to attract positive ions. It will be understood, however, that positive voltages may be utilized to attract negative ions. The ion inlet structure 316 and the secondary electrode 320 face each other and are separated by an ionization region 336. The sample emitter 308 is oriented so as to direct the sample spray into the ionization region 336 where it is subjected to an electrostatic field having a strength sufficient to extract analyte ions from the sample spray. The ion inlet structure 316 includes a sampling orifice (or ion inlet) 340 facing the ionization chamber 304, and a sampling bore 342 communicating with the sampling orifice 340. The magnitude of the voltage applied to the ion inlet structure 316 is greater than the magnitudes of the voltages applied to the sample emitter 308 and the secondary electrode 320, thereby biasing ions toward the sampling orifice 340. The sampling bore 342 in turn communicates with a capillary 346 that extends through the inside wall 310 into the mass spectrometer 312. The capillary 346 may include one or more capillary bores 348. Thus, ions passing through the sampling orifice 340 flow through the sampling bore 342 and into the evacuated regions of the mass spectrometer 312 via the capillary bore(s) 348.

The API apparatus 300 also includes a gas passage 352 that receives a flow of drying gas 328 from a suitable drying gas source (not shown). The gas passage 352 terminates at a gas outlet 354 in the ionization chamber 304. From the drying gas source, the path of the drying gas runs through an opening of the inside wall 310 and out from the gas outlet 354. The gas outlet 354 typically constitutes a single orifice as illustrated, or two orifices. The velocity of the drying gas in the known API apparatus 300 as the drying gas enters the ionization chamber 304 typically ranges from 5 m/s to 15 m/s, with 15 m/s being common. As noted above, known API apparatus such as illustrated in FIG. 3 do not adequately control the velocity (or flow rate) or the direction of the drying gas as it enters the ionization chamber 304, thus creating excessive turbulence in, and non-uniform and insufficient heating of, the ionization chamber 304. Additionally, the secondary electrode 320 is typically shaped as a basic cylinder having an end surface 358 facing the ion inlet structure 316 and a lateral surface 360 adjoining the end surface 358 at a sharp edge. As illustrated, the interfacial region between the end surface 358 and the lateral surface 360 may be chamfered in an attempt to improve gas flow around the secondary electrode 320, but the chamfered geometry presents additional sharp edges. Thus, the portion of the drying gas flowing around the secondary electrode 320 (and therefore proximal to the sample spray), which portion is designated 364 in FIG. 3, is highly turbulent as well as having a high velocity. As also noted above, in operation a conical, low-pressure gas stagnation zone 366 occurs in front of the secondary electrode 320, in which little or no gas flows. The stagnation zone 366 fluctuates into and out from the sample spray and consequently destabilizes the sample spray. Moreover, the drying gas is not directed so as to heat the ionization chamber 304 uniformly. As a result, the known API apparatus 300 does not maintain a stable, smooth sample spray or a uniformly heated environment that would promote the production of high-mass ions. As also note above, the unstable sample spray allows non-analytical droplets and air/oxygen to enter the mass spectrometer 312.

Figure 4:
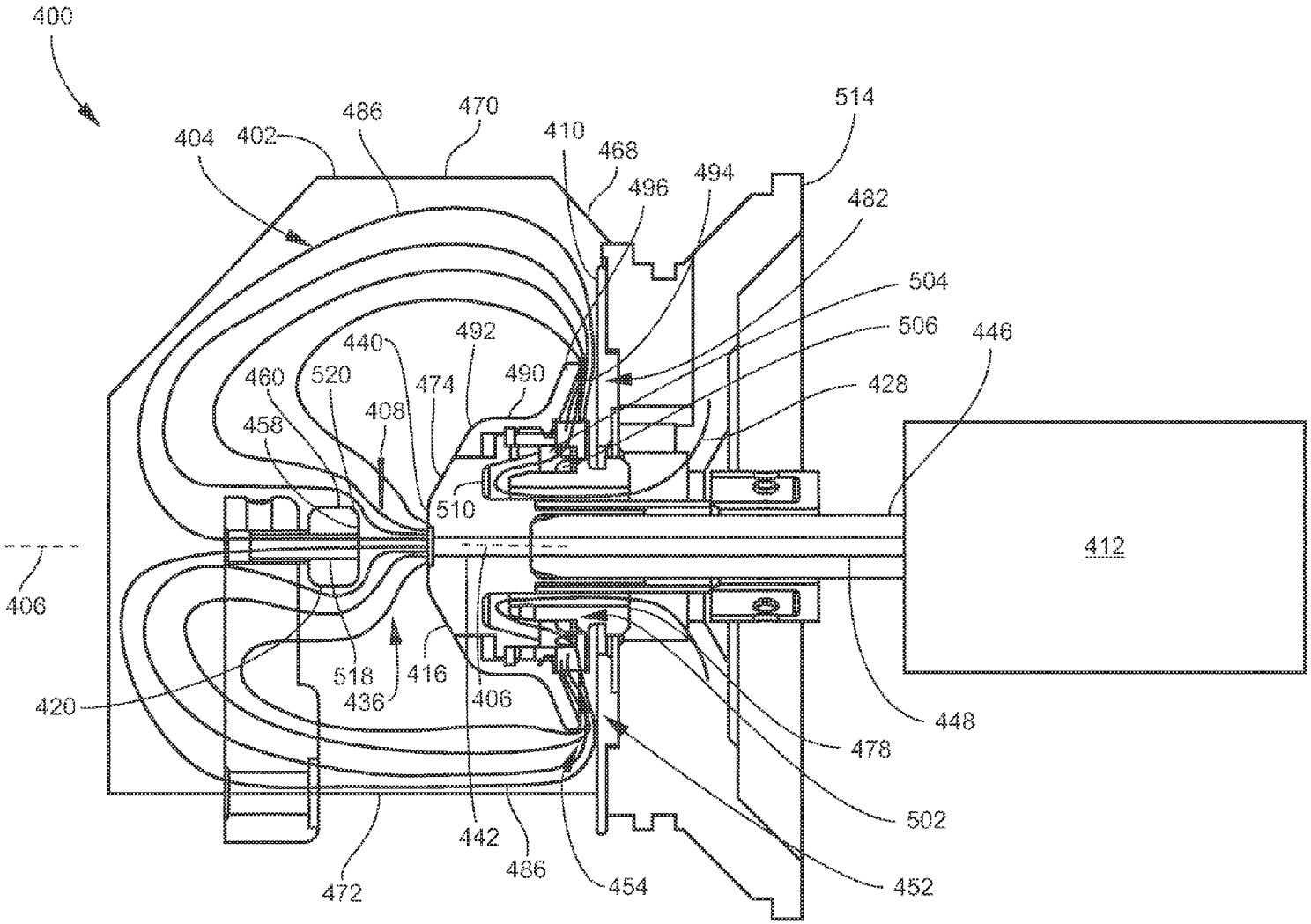
FIG. 4 is a cross-sectional view of an example of an API apparatus as disclosed herein according to one implementation, illustrating lines that depict gas flow.

FIG. 4 is a cross-sectional view of an example of an API apparatus 400 according to one implementation taught herein. The API apparatus 400 includes a housing 402 that includes one or more inside surfaces (e.g., 468, 470, 472) enclosing an ionization chamber 404. The API apparatus 400 is adjacent to a mass spectrometer 412. One or more inside walls 410 in the housing 402 separate the mass spectrometer 412 from the ionization chamber 404, and with the inside surface(s) (e.g., 468, 470, 472) cooperatively define the ionization chamber 404. A sample emitter 408 is positioned in the ionization chamber 404 and may be in position for fluid communication with a sample source (not shown) and in signal communication with a voltage source (not shown). The sample material is discharged from the tip of the sample emitter 408 as an electrically charged sample stream (or sample column, sample jet, or sample spray) containing a mixture of charged and neutral components. In some implementations, the sample material is a low-flow electrospray that is discharged from the sample emitter 408 at a flow rate of 20 μL/min or less, or a nanospray that is discharged from the sample emitter 408 at a flow rate of 5 μL/min or less, or a nanospray that is discharged from the sample emitter 408 at a flow rate of 1 μL/min or less. In these low-flow implementations, the inside diameter of the sample emitter 408 may range, for example, from 700 nm to 35,000 nm (0.7 μm to 35 μm).

The API apparatus 400 further includes an ion inlet structure 416 and a secondary electrode 420 positioned in the ionization chamber 404. For reference purposes, the ion inlet structure 416 may be characterized as being located on a sampling axis 406. In the present example, the secondary electrode 420 is also located on the sampling axis 406. In other implementations, the secondary electrode 420 may be offset from (but generally parallel with) the sampling axis 406, or positioned at an angle to the sampling axis 406. The ion inlet structure 416 is in signal communication with a voltage source (not shown) and functions as a primary electrode for generating an electrostatic field. Voltage potentials are established between the sample emitter 408 and the ion inlet structure 416, and between the sample emitter 408 and the secondary electrode 420. The resulting electrostatic fields extract ions out from the sample stream. The ion inlet structure 416 and the secondary electrode 420 face each other and are separated over an axial distance (along the sampling axis 406, which is horizontal from the perspective of FIG. 4) by a gap, which may be referred to as an ionization region (or ionization zone) 436. The tip (outlet) of the sample emitter 408 may be located at a small distance above the ionization region 436, and at an intermediate axial position relative to the ion inlet structure 416 and the secondary electrode 420. The sample emitter 408 (or at least the tip of sample emitter 408) is oriented so as to direct the sample stream into the ionization region 436. In the illustrated example, the sample emitter 408 is oriented orthogonal (90 degrees) to the sampling axis 406. More generally, the sample emitter 408 may be substantially orthogonal (90±20 degrees) to the sampling axis 406, while in other implementations the sample emitter 408 may be oriented at a greater angle relative to the sampling axis 406.

The voltage applied to the ion inlet structure 416 may range, for example, from 100 V to 6000 V. The voltage applied to the secondary electrode 420 may range, for example, from 100 V to 1000 V less than the voltage applied to the ion inlet structure 416. The electrostatic fields resulting from applying voltages at these magnitudes, coupled with the low flow rate of the sample material from the sample emitter 408, enable ions to be extracted directly from the surface of the sample stream exiting the sample emitter 408. With this configuration, it has been observed that the majority of the ions are liberated at or near the tip of the sample emitter 408.

The ion inlet structure 416 includes a sampling orifice (or ion inlet) 440 facing the ionization chamber 436 and coaxial with the sampling axis 406. Analyte ions thus pass through the sampling orifice 440 along the sampling axis 406. The ion inlet structure 416 also includes a sampling bore 442 communicating with the sampling orifice 440 and extending through a body of the ion inlet structure 416. The sampling bore 442 in turn communicates with an ion transport device that extends through the inside wall 410 into the mass spectrometer 412. The ion transport device may be any component or combination of components suitable for transporting ions from the atmospheric-pressure ionization chamber 404 to the evacuated region of the mass spectrometer 412. Accordingly, the ion transport device may include one or more conduits and/or optics such as lenses. In the present implementation, the ion transport device is or includes a capillary 446. The capillary 446 may include one or more capillary bores 448. The inside diameter of the sampling orifice 440 may be the same as, or may be less or substantially less than, the inside diameter of the sampling bore 442. The sampling orifice 440 may be a single orifice, or may be arrangement of multiple orifices, or may include an electrically conductive mesh or screen for straightening equipotential field lines. The pressure gradient between the ends of the capillary 446 may be sufficient for pulling the ions through the capillary 446, or the capillary 446 may be biased by a voltage of appropriate magnitude and polarity that is applied by a voltage source (not shown). The ion inlet structure 416 further includes an outer surface 474 facing the ionization chamber 404. The outer surface 474 may include the sampling orifice 440—that is, the sampling orifice 440 may be in registry with, be formed in, or extend through the outer surface 474. The outer surface 474 functions as the primary electrode and as a spray shield.

The API apparatus 400 also includes a gas passage 452 that receives a flow of drying gas from a suitable drying gas source (not shown). The gas passage 452 may be formed by various structures and terminates at a gas outlet 454 in the ionization chamber 404. The drying gas flows along a flow path 428 that generally runs from the drying gas source, through a gas inlet 478 into the gas passage 452, and out from the gas outlet 454. The gas passage 452 includes an outward-directed portion (or radial directed portion) 482. The outward-directed portion 482 is annular, or swept, about the sampling axis 406 and also extends in outward directions relative to the sampling axis 406. In the present context, the term "outward directions," or "radial directions," means that the flow path through the outward-directed portion 482 has at least a radial (orthogonal) component relative to the sampling axis 406, and may or may not have an axial component. Here, the axial component is considered from the perspective of the plane of the drawing sheet of FIG. 4. The existence of a non-zero axial component means that the outward-directed portion 482 is oriented at a non-ninety degree angle relative to the sampling axis 406, i.e., is angled either toward or away from the inside surface 410 of the housing 402, again from the perspective of the plane of the drawing sheet of FIG. 4. The term "outward directions" or "radial directions" also means that the drying gas may flow along many radii directed outward (or radial) from the sampling axis 406. By this configuration the drying gas enters the ionization chamber 404 in the outward (or radial) directions, after which the drying gas is diverted by inside surfaces of the housing 402, such as by one or more top inside surfaces (e.g., 468, 470) and one or more bottom inside surfaces (e.g., 472), as depicted by flow lines 486 in FIG. 4. Also, a portion of the drying gas flows along or in close proximity to a majority or all of the inside surfaces defining the ionization chamber 404, thus making good thermal contact with and uniformly heating these inside surfaces.

In the present implementation, the API apparatus 400 includes a flared structure 490 that is coaxially disposed about the sampling axis 406 and the ion inlet structure 416. The flared structure 490 may be attached to the ion inlet structure 416 in which case the flared structure 490 may be considered to be a part or extension of the ion inlet structure 416. The flared structure 490 includes an outer surface 492 facing toward the ionization chamber 404, an opposing outer surface 494 facing toward the inside wall 410, and a rim 496 at the transition between the two outer surfaces 492 and 494. The transitions between these outer surfaces 492 and 494 and the rim 496 are smooth or rounded, i.e., without any sharp edges. The outer surface 492 facing the ionization chamber 404 may abut the outer surface 474 of the ion inlet structure 416 without any appreciable gap or step between these two outer surfaces 492 and 474, thereby providing a smooth transition between the two outer surfaces 492 and 474 and avoiding localized turbulence at this area. The outer surface 492 facing the ionization chamber 404 may be curved. The curvature of the outer surface 492 may include one or more inflection points, which are smooth or rounded (i.e., without sharp edges). In the illustrated example, the outer surface 492 includes two inflection points of opposite signs, i.e., one part of the outer surface 492 is convex while the other part is concave. The inside wall 410 and the outer surface 494 facing the inside wall 410 may cooperatively form or define the annular, outward-directed (or radial-directed) portion 482 of the gas passage 452. The gas outlet 454 of the gas passage 452 is located between the rim 496 and the inside wall 410, and is an annular opening. In the illustrated example, the flared structure 490 extends at an angle toward the inside wall 410, i.e., the outward direction in this case has both a radial component and an axial component. Consequently, the cross-sectional flow area of the annular, outward-directed portion 482 of the gas passage 452 tapers down until terminating at the gas outlet 454.

Also in the implementation illustrated in FIG. 4, the API apparatus 400 includes a gas distributor 502 coaxially disposed about the sampling axis 406 and forming a part of the gas passage 452. The gas distributor 502 includes an annular plenum 504 communicating with the drying gas source, and a plurality of radial holes 506 formed in a wall of the plenum 504. The radial holes 506 are circumferentially spaced from each other about the sampling axis 406 and communicate with the outward-directed portion 482 of the gas passage 452. In some non-limiting examples, the number of radial holes 506 ranges from 10 to 30. In some non-limiting examples, the inside diameter of each radial hole 506 ranges from 1 mm to 5 mm. In some implementations, the inside diameter of one or more of the radial holes 506 is different from the inside diameter of the other radial holes 506. The radial holes 506 ensure uniform distribution of the drying gas into the outward-directed portion 482, and assist in reducing the velocity of the drying gas. Also in the present example, the API apparatus 400 further includes a conduit that serves as the gas inlet 478 and is located at the inside wall 410. The back side (facing away from the ionization chamber 404) of the ion inlet structure 416 includes an annular recess 510 coaxial with the sampling axis 406. The gas inlet 478 in this example includes a cylindrical structure that extends into the annular recess 510. Accordingly, in this example the flow path of the drying gas runs from the drying gas source, through a structure 514 of the mass spectrometer 412, through the gas inlet 478, and into the annular recess 510, toward the back side of the ion inlet structure 416. Due to the extension of the gas inlet 478 into the annular recess 510, the flow path of the drying gas takes a turn and then runs from the annular recess 510 through the plenum 504, through the radial holes 506, through the outward-directed portion 482, and through the gas outlet 454 into the ionization chamber 404.

As a result of the configuration of the gas passage 452, the drying gas flows into the ionization chamber 404 at a low velocity, flows through the ionization chamber 404 with low turbulence, makes good thermal contact with the inside surfaces of the housing 402, and uniformly distributes heat energy to the ionization chamber 404, as schematically depicted by flow lines 486 in FIG. 4. In the present context, the low velocity of the drying gas exiting the gas outlet 454 may generally range from 5 m/s to 15 m/s. In implementations entailing low flow electrospray or nanospray, the low velocity of the drying gas exiting the gas outlet 454 may range from 0.01 m/s to 1.0 m/s. In some implementations, the low velocity of the drying gas exiting the gas outlet 454 may range from 0.01 m/s to 0.5 m/s. The gas passage 452 may be configured to slow down the flow of the drying gas from an initially high velocity upstream (such as at the gas inlet 478 or the outlet of the drying gas source) down to the low velocity. For example, the velocity of the drying gas as it passes through the gas inlet 478 may range from 5 m/s to 15 m/s. Additionally, the improved flow of the drying gas has been found to increase the average temperature of the volume of the ionization chamber 404 by approximately 20° C. In some implementations, the average temperature of the volume of the ionization chamber 404 during operation ranges from 10° C. to 125° C. The increased temperature improves the sensitivity of the mass spectrometer 412, particularly with regard to high-mass ions. The low gas velocities reduce turbulence and result in the production of a smooth, steady sample stream. Consequently, the intensity of the detected ion signal may be increased by, for example, as much as five times.

As also illustrated in FIG. 4, an electrode bore 518 is formed through the secondary electrode 420. In the present implementations, the electrode bore 518 is an axial bore that is coaxial with the sampling axis 406. As indicated by the flow lines, drying gas in the ionization chamber 404 is able to flow through the electrode bore 518. Specifically, the drying gas is pulled through the electrode bore 518 in the direction of the ionization region 436 due to a pressure gradient. That is, the drying gas flows from the back of the electrode bore 518 to the front (facing the ionization region 436) of the electrode bore 518. As a result, the above-described fluctuating stagnation zone 366 (FIG. 3) that develops in known API apparatus such as that illustrated in FIG. 3 is eliminated, thereby greatly reducing or eliminating turbulence in the sample stream in the ionization region 436 and preventing non-analytical droplets from entering the mass spectrometer 412. Additionally, the secondary electrode 420 may be configured without any sharp edges, corners or other abrupt geometrical features, which also contributes to the reduction or elimination of turbulence. In the illustrated example, the secondary electrode 420 (or at least the portion of the secondary electrode 420 proximate to the ionization region 436) is generally cylindrical, with an end surface 458 facing the ionization region 436 and a lateral surface 460 coaxial with the sampling axis 406. A rounded, annular region 520 adjoins the end surface 458 with the lateral surface 460 such that the secondary electrode 420 presents no sharp edges in the vicinity of the ionization region 436.

As evident from the foregoing, the API apparatus 400 may attain one or more of the following attributes: the drying gas may flow from the gas outlet 454 into the ionization chamber 404 at a low flow rate (and velocity); the gas passage 452 may reduce the velocity of the drying gas from a relatively high initial velocity upstream of the gas passage 452 down to a low velocity at the gas inlet 478; the drying gas may provide a continuous transfer of heat to the solid portion of the ion inlet structure 416, via thermal contact with the back side of the ion inlet structure 416, to maintain the ion inlet structure 416 at an elevated temperature that promotes ion evaporation; the drying gas may be discharged into the ionization chamber 404 in a direction that is diverted away from the sampling orifice 440, and countercurrent gas is not needed to keep droplets away from the sampling orifice 440; upon discharge from the gas outlet 454, the drying gas may be distributed uniformly through the ionization chamber 404 so as to uniformly heat the volume throughout the ionization chamber 404 and its various inside surfaces; upon discharge from the gas outlet 454, the drying gas may flow through the ionization chamber 404 at low velocity and with significantly reduced turbulence; and an aerodynamically quiet zone may be created in the ionization region 436 between the ion inlet structure 416 and the secondary electrode 420 that enhances the collection of analyte ions from the sample stream, with no fluctuating stagnation zone existing to perturb the sample stream.

In addition, in known API apparatus such as shown in FIG. 3, it has been found that the strength of the electrostatic field is too high in at least a portion of the sample spray. The excessively high field strength increases space-charge density in the sample spray and consequently increases the dispersion of the ions, which in turn reduces the amount of ions able to be collected and drawn into the sampling orifice 340. By comparison, an ion source implemented as in the example of the API apparatus 400 shown in FIG. 4 provides a more optimized electrostatic field. The electrode bore 518 has the effect of lowering the strength of the electrical field in a portion of the sample stream in front of the secondary electrode 420. This lowered field strength reduces space-charge density, which allows more ions to enter the capillary 446 by reducing the dispersion that would be caused by a higher-strength field.

Figure 5:
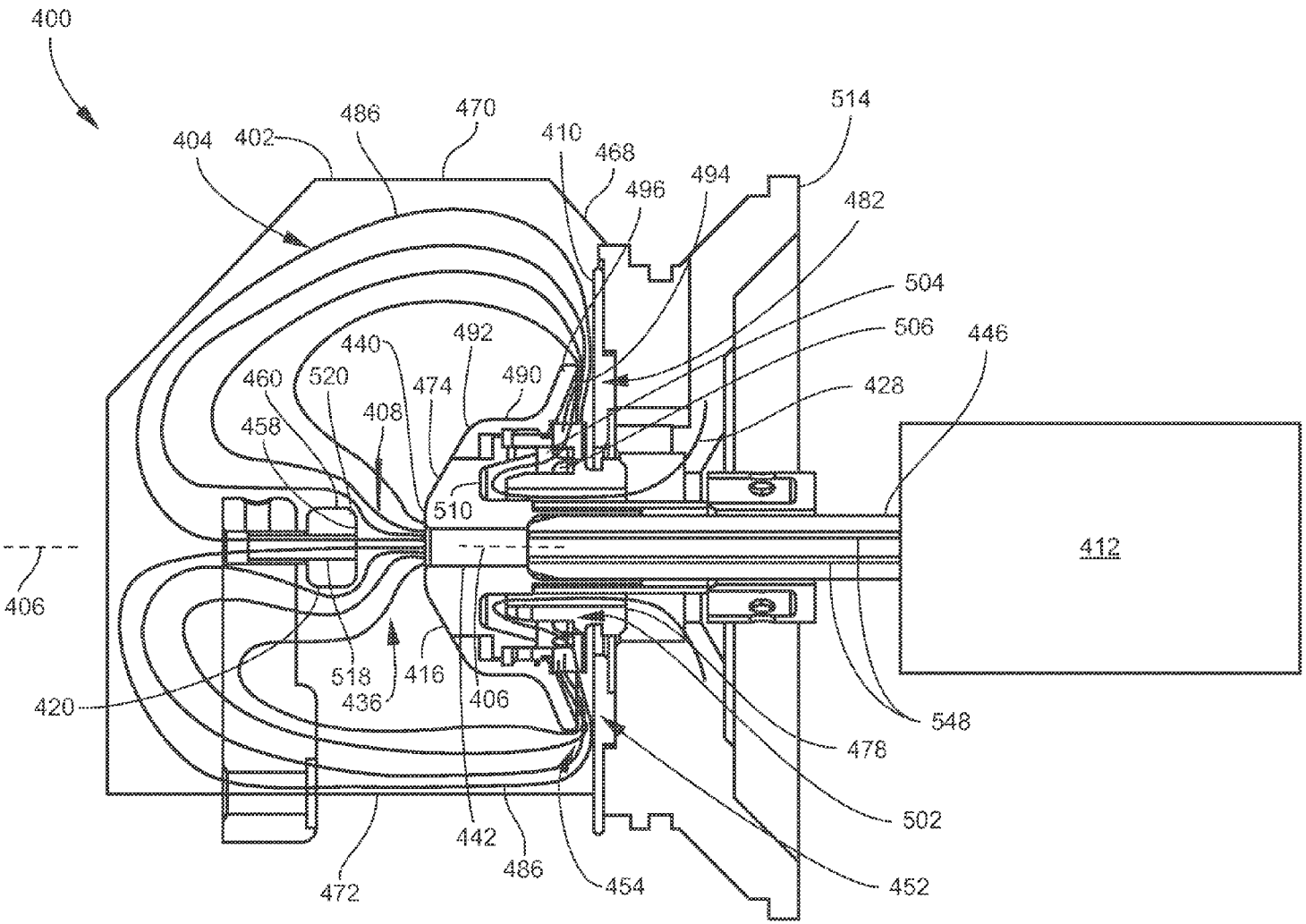
FIG. 5 is a cross-sectional view of an example of an API apparatus as disclosed herein according to another implementation.

FIG. 5 is a cross-sectional view of an example of an API apparatus 500 as disclosed herein according to another implementation. In this implementation, the ion transport device includes multiple capillary bores 548. The capillary bores 548 may be circumferentially arranged about the sampling axis 406 as in the illustrated example. The inside diameter of the sampling bore 442 is large enough to ensure fluid communication with all capillary bores 548 simultaneously. The inside diameter of the sampling orifice 440 may be the same as, or may be less or substantially less than, the inside diameter of the sampling bore 442. The sampling orifice 440 may be a single orifice, or may be arrangement of multiple orifices, or may include an electrically conductive mesh or screen for straightening equipotential field lines. The API apparatus 500 may otherwise be configured the same as or similar to the API apparatus 400 described above and illustrated in FIG. 4.

The present subject matter has been described above primarily in the context of ESI, and particularly low-flow electrospray and nanospray techniques. It will be understood, however, that one or more components or features of the API apparatus 400 or 500 described herein may be utilized in conjunction with other API techniques such as, for example, APCI, APPI, APLI, and AP-MALDI. Moreover, while the implementations described above have been presented primarily in the context of MS, it will be understood that the broad aspects of the subject matter may be applicable to other types of analytical instrumentation, or more generally to any process involving the production of ions from fluent sample material at atmospheric pressure.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

For purposes of the present disclosure, it will be understood that when a layer (or film, region, substrate, component, device, or the like) is referred to as being "on" or "over" another layer, that layer may be directly or actually on (or over) the other layer or, alternatively, intervening layers (e.g., buffer layers, transition layers, interlayers, sacrificial layers, etch-stop layers, masks, electrodes, interconnects, contacts, or the like) may also be present. A layer that is "directly on" another layer means that no intervening layer is present, unless otherwise indicated. It will also be understood that when a layer is referred to as being "on" (or "over") another layer, that layer may cover the entire surface of the other layer or only a portion of the other layer. It will be further understood that terms such as "formed on" or "disposed on" are not intended to introduce any limitations relating to particular methods of material transport, deposition, fabrication, surface treatment, or physical, chemical, or ionic bonding or interaction. The term "interposed" is interpreted in a similar manner.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An atmospheric pressure ionization apparatus, comprising:

a housing comprising a chamber;

an ion inlet structure comprising a sampling orifice coaxial with a sampling axis and communicating with the chamber;

an electrode spaced from the ion inlet structure, wherein an ionization region is defined between the ion inlet structure and the electrode, the electrode comprising an electrode bore formed through the electrode between two openings into the chamber, wherein the electrode bore has two ends that both open into the chamber, and at least one of the two ends faces the ionization region;

a flared structure coaxially disposed about the ion inlet structure and extending along an outward direction that includes a radial component relative to the sampling axis;

a sample emitter disposed in the chamber and oriented at an angle to the sampling axis for directing a sample stream toward the ionization region; and a gas passage configured for directing a stream of gas from a gas source to the chamber, wherein the flared structure forms a portion of the gas passage, the portion extending annularly about the sampling axis and along the outward direction, and the gas flows through the portion, around the flared structure, and through the electrode bore toward the ionization region.

2. The atmospheric pressure ionization apparatus of claim 1, wherein the gas passage comprises a gas distributor, the gas distributor comprising a plenum coaxial with the sampling axis and communicating with the gas source, and a plurality of outlets circumferentially spaced from each other about the sampling axis and communicating with the portion.

3. The atmospheric pressure ionization apparatus of claim 1, wherein the electrode comprises a cylindrical portion through which the electrode bore extends, the cylindrical portion comprising an end surface facing the ionization region, a lateral surface coaxial with the electrode bore, and an annular transition between the end surface and the lateral surface, and the annular transition is rounded wherein the cylindrical portion is free of sharp edges.

4. The atmospheric pressure ionization apparatus of claim 1, wherein the ion inlet structure comprises a sampling bore communicating with the sampling orifice, and further comprising an ion transport device, the ion transport device comprising a channel communicating with the sampling bore.

5. The atmospheric pressure ionization apparatus of claim 4, wherein the ion transport device comprises a plurality of channels communicating with the sampling bore.

6. The atmospheric pressure ionization apparatus of claim 1, wherein the sample emitter has an internal diameter ranging from 700 nm to 35,000 nm.

7. The atmospheric pressure ionization apparatus of claim 1, wherein the sample emitter is configured for emitting the sample stream into the chamber at a flow rate ranging from 0.0001 μL/min to 20 μL/min.

8. The atmospheric pressure ionization apparatus of claim 1, wherein the portion terminates at an annular gas outlet communicating with the chamber, the annular gas outlet is defined between a rim of the flared structure and an inside wall of the housing.

9. The atmospheric pressure ionization apparatus of claim 1, comprising a gas inlet extending through an inside wall of the housing and communicating with the gas passage.

10. The atmospheric pressure ionization apparatus of claim 9, wherein the ion inlet structure comprises an annular recess, the gas inlet comprises a cylindrical structure extending into the annular recess, and the annular recess and the cylindrical structure cooperatively define a gas path running axially from the gas inlet toward the ion inlet structure, followed by running toward the gas passage at an angle to the sampling axis.

11. The atmospheric pressure ionization apparatus of claim 10, wherein the gas passage comprises a gas distributor, the gas distributor comprising a plenum communicating with the annular recess, and a plurality of outlets circumferentially spaced from each other about the sampling axis and communicating with the portion.

12. The atmospheric pressure ionization apparatus of claim 1, wherein the gas passage is configured for moving the stream of gas into the chamber at a velocity ranging from 0.01 m/s to 1.0 m/s.

13. A mass spectrometry system comprising the atmospheric pressure ionization apparatus of claim 1, and further comprising an ion transport device communicating with the sampling orifice and extending through an inside wall of the housing, and a mass spectrometer communicating with the ion transport device and separated from the chamber by the inside wall.

14. A method for ionizing a sample, the method comprising:

discharging a sample stream from a sample emitter into an ionization region located between an ion inlet structure and a secondary electrode in a chamber, the secondary electrode comprising an electrode bore formed through the secondary electrode between two openings into the chamber, wherein the electrode bore has two ends that both open into the chamber, and at least one of the two ends faces the ionization region;

subjecting the sample stream to an electrostatic field by applying respective voltages to the sample emitter, the ion inlet structure, and the secondary electrode, wherein ions are produced and enter the ion inlet structure along a sampling axis;

flowing a drying gas through a gas passage in a plurality of radial directions relative to the sampling axis, and toward the ionization region; and flowing a portion of the drying gas through the electrode bore and into the ionization region.

15. The method of claim 14, comprising flowing the drying gas through an annular portion of the gas passage between a flared structure and an inside wall of the chamber, wherein the flared structure extends coaxially about the ion inlet structure.

16. The method of claim 15, comprising flowing the drying gas through a plenum, through a plurality of radial holes and into the annular portion, wherein the plenum and the radial holes are coaxial with the sampling axis.

17. The method of claim 16, comprising flowing the drying gas into contact with a back side of the ion inlet structure opposite to the ionization region, changing a direction of the drying gas, and flowing the drying gas into the plenum.

18. The method of claim 14, comprising flowing the drying gas through a plenum, through a plurality of radial holes and into the gas passage.

19. The method of claim 14, comprising discharging the sample stream from the sample emitter at a flow rate ranging from 0.0001 μL/min to 20 μL/min.

20. The method of claim 14, comprising flowing the drying gas from the gas passage into the chamber at a velocity ranging from 0.01 m/s to 1.0 m/s.

* * * * *